US006363582B1

(12) United States Patent
Van Bladel et al.

(10) Patent No.: US 6,363,582 B1
(45) Date of Patent: Apr. 2, 2002

(54) PIN-ON CLIP

(75) Inventors: Wil Van Bladel, Burg. Hendrixstraat 56, 2651 JV Berkel en Rodenrijs (NL); Alec Planinc, Amandas Gard 3, LGH 38, S-41483 Goteborg (SE)

(73) Assignees: Wil Van Bladel; Alec Planinc, both of (SE)

( * ) Notice: Subject to any disclaimer, the term of this patent is extended or adjusted under 35 U.S.C. 154(b) by 0 days.

(21) Appl. No.: 09/403,212

(22) PCT Filed: Apr. 6, 1998

(86) PCT No.: PCT/EP98/01999

§ 371 Date: Oct. 14, 1999

§ 102(e) Date: Oct. 14, 1999

(87) PCT Pub. No.: WO98/47125

PCT Pub. Date: Oct. 22, 1998

(30) Foreign Application Priority Data

Apr. 14, 1997 (DE) ..... 197 15 443

(51) Int. Cl.[7] ..... A44B 9/02; G09F 3/16

(52) U.S. Cl. ..... 24/67.3; 24/67.9; 24/67.11; 24/711.1; 24/711.3

(58) Field of Search ..... 24/67.3, 67.9, 24/67.11, 711, 711.1, 711.3

(56) References Cited

U.S. PATENT DOCUMENTS

| | | | | | |
|---|---|---|---|---|---|
| ,089,966 | A | * | 5/1869 | Bailey | 24/67.11 |
| ,721,996 | A | * | 3/1903 | Bunnell | 24/67.3 |
| 1,373,988 | A | * | 4/1921 | Wallick | 24/67.11 |
| 2,008,019 | A | * | 7/1935 | Horlick, Jr. | 24/67.11 |
| 2,767,450 | A | * | 10/1956 | Overbaugh | 24/711 |
| 3,638,282 | A | * | 2/1972 | Larsson | 24/67.3 |
| 4,425,724 | A | * | 1/1984 | Scott | 24/67.9 |
| RE,031,799 | E | * | 1/1985 | Paskerian | 40/152.1 |
| 4,597,139 | A | * | 7/1986 | Lau | 24/67.9 |
| 5,029,788 | A | * | 7/1991 | Hoskinson et al. | 248/218.1 |

FOREIGN PATENT DOCUMENTS

| | | | | |
|---|---|---|---|---|
| DE | 573 312 C | | 3/1933 | |
| FR | 1489764 | * | 7/1967 | 24/67.9 |
| GB | K01695 A | | 11/1910 | |
| GB | 0643132 | * | 9/1950 | 24/67.3 |
| GB | 2 155 094 A | | 9/1985 | |
| WO | WO 95 19023 | | 7/1995 | |

* cited by examiner

*Primary Examiner*—Victor N. Sakran
(74) *Attorney, Agent, or Firm*—Willams, Morgan & Anderson

(57) ABSTRACT

The invention relates to pin-on clip, which is characterized by a support plate comprising a receiving orifice and a printable plate which can be applied to the support plate, having a visible side and a holding clip located on the outer face of the rear side of the pin-on clip. The holding clip is preferably made of metal and can be secured in the receiving orifice by a clamp.

20 Claims, 4 Drawing Sheets

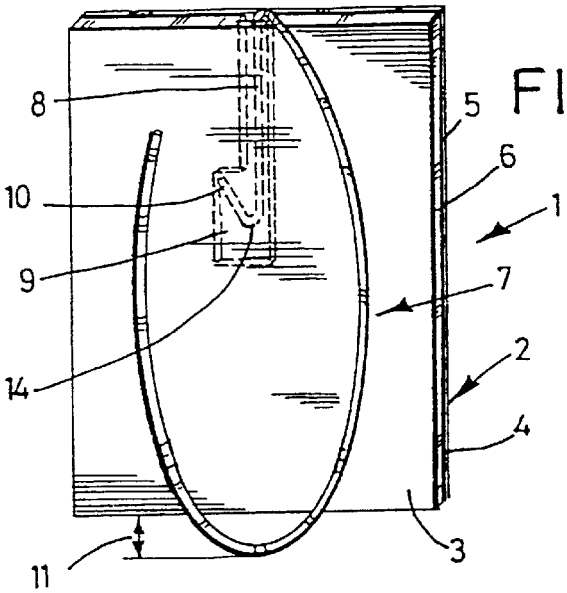
FIG. 1
FIG. 2
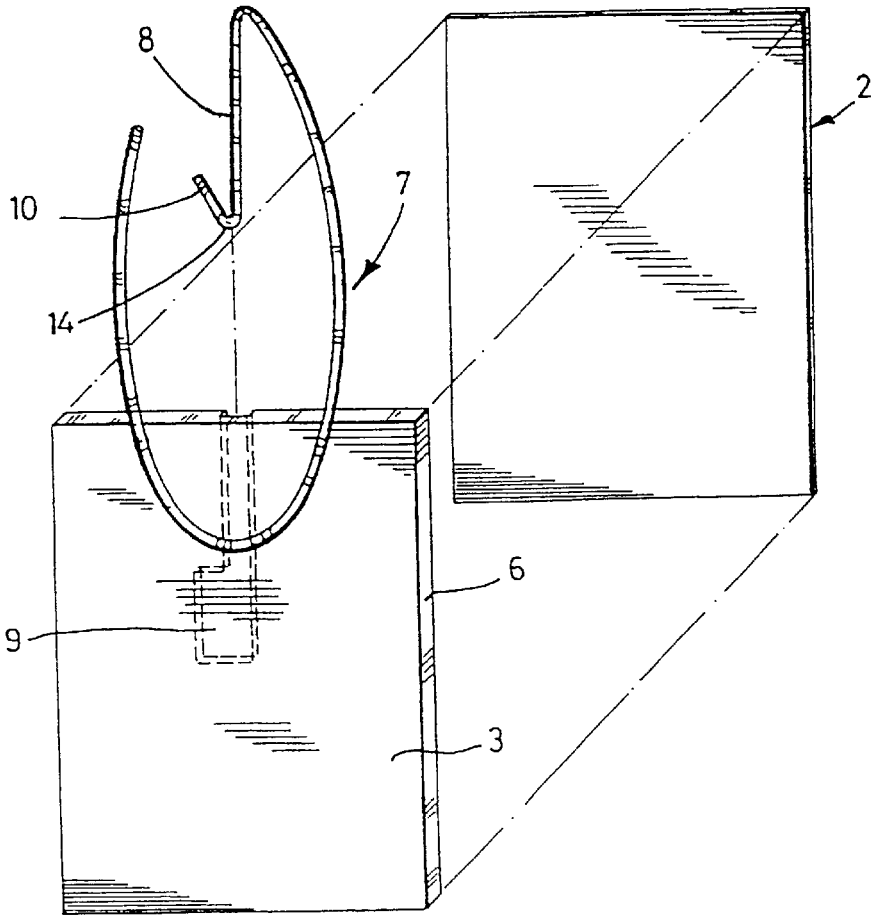

PIN-ON CLIP

The invention relates to a pin-on clip according to the preamble of the main claim.

The preamble of the main claim starts out from GB 2155094A.

In many areas of everyday life and particularly in advertising, there is a need for pin-on clips that can be inexpensively produced and enable printing with every conceivable kind of inks and motifs, whereby during printing, the intention is to use any printing techniques that belong to the prior art, particularly those usually encountered in the paper industry.

The invention is based upon the object of designating a pin-on clip in which at least the visible side is formed by a printable plate made of paper and which can be printed by means of printing techniques commonly encountered in the graphic industry, whereby the joining of this printable plate to the other holding members of the clip is intended to be possible semi-automatically or fully automatically.

This object upon which the invention is based is solved by the teaching of the main claim.

Advantageous embodiments are explained in the dependent claims.

A prize ribbon for sports purposes is known from DE 37 41 702 A1 and comprises a rosette preferably provided with ribbon ends, this rosette having a data carrier plate and an attachment member located therebehind, The data carrier plate is detachably connected, preferably detachably connected to the attachment member. The components are intended to be injection-molded from plastic, thus also achieving the necessary clamping action between the data carrier plate and the attachment member. The manner in which the necessary holding clip is attached is not explained in further detail, and its manufacture is not possible using means common in the paper industry.

An attachment clip for securing items of jewelry which are at least sectionally hollow is known from DE-U 92 01 369, whereby use is made of a resilient attaching bend which is fitted with a positioning bend that engages with the interior of the item of jewelry. The positioning bend is provided with a catch projection for locking in a recess of the wall of the item of jewelry. A pin-on clip that is essentially made of paper is not explained here, with the result that the problems posed in the device according to the invention do not arise.

WO 95/19023 describes an information carrier that can be used in conjunction with a paper clip. This particular information carrier comprises a paper blank that can be correspondingly folded and into which the paper clip can be inserted. This arrangement is not very durable and is not, for example, suitable as an advertising medium for publicity-related information.

Finally, a pin-on clip is know from GB-21 55 094. This pin-on clip is essentially composed of plastic, whereby a corresponding paper printable plate can be placed on a plastic support plate. Securing also occurs here by means of a normal paper clip.

In other words, the invention proposes the manufacture of a pin-on clip in that this pin-on clip at least comprises a printable plate that has a visible side, a support plate and a holding clip, this holding clip being able to be attached to the support plate. The printable plate and support plate are adhered together and at least the printable plate is made of paper, thus making it possible, as a result, to print the printable plate and hence the visible side of this printable plate in any printing process. It also is possible here to use large printing sheets which consequently have ten, twenty, or even more individual prints that are adhered to the support plate and cut apart. pressure plate and hence the visible side of this pressure plate in any printing process. It also is possible here to use large printing sheets which consequently have ten, twenty or even more individual prints that are adhered to the support plate and cut apart.

The actual holding clip, which is usually made of metal, is inserted into a corresponding receiving orifice within the support plate.

This receiving orifice can be produced by forming a corresponding groove on the side of the support plate which faces toward the printable plate, for example by pressing it in, or by adopting such an approach that the pin-on clip is formed in three parts in that it has a printable plate, a support plate and a rear cover plate. In this case, the receiving orifice for the holding clip can e.g. be punched out within the support plate.

The individual components, with the exception of the holding clip, are preferably made of paper or cardboard. In this way, the printable plate may comprise a thin layer of paper which is printed on its visible side, the support plate may comprise a thicker layer of cardboard which exhibits a corresponding load capacity and makes it possible to punch out the receiving orifice, and finally the reverse cover plate may in turn comprise paper which can be napped toward its outer side, thus allowing the pin-on clip to be located securely on the wearer's jacket etc. the holding clip with its anchoring bracket in the associated receiving orifice.

Whereas the printable plate, support plate and cover plate may be made of paper or paper-like material, the actual holding clip is itself composed of metal or plastic and exhibits as a result the necessary strength and springiness. Its size is chosen in such a way that the clip projects over the lower edge of the actual pin-on clip.

In a preferred embodiment, the actual support plate is made of microcorrugated cardboard in which the corrugations of the microcorrugated cardboard are aligned transverse to the alignment of the holding clip. In the case of a rectangular pin-on clip which is usually aligned horizontally, the corrugations extend in the direction of the longitudinal axis and hence transverse to the alignment of the holding clip. The front cover plate of the microcorrugated cardboard serves to receive the printable plate, and the rear cover plate of the microcorrugated cardboard serves to receive a reverse cover plate which is necessary in this exemplary embodiment in order to prevent distortions of the support plate as a result of applying the necessary adhesive layer.

In the reverse and front cover plates of the microcorrugated cardboard or in the corrugations of the microcorrugated cardboard and optionally the reverse cover plate there is respectively provided a punched-in section which is intended to receive hook-like ends of bends of the holding clip, whereby the bent hook-like ends then extend in the direction of the corrugation troughs or peaks of the microcorrugated cardboard, In this exemplary embodiment, mass production is possible using production techniques which are normal in the paper industry, with the result that cost-effective manufacturing is achievable.

A layer of foam material such as a foamed polystyrene can also be used instead of the microcorrugated cardboard; this layer of foam therefore exhibits corresponding load capacity and dimensional rigidity.

Attention is explicitly drawn to the fact that the visible side of the printable plate and hence the printable plate itself as well as the other plates do not absolutely have to exhibit a circular, quadratic, rectangular or polygonal design, but may exhibit any circumferential shape.

Instead of the aforementioned choice of material, namely paper and metal, it goes without saying that corresponding plastic parts, textiles etc. can also be combined together or used on their own and that in particular the visible side of the printable plate may also exhibit a relief-like design.

Exemplary embodiments of the invention will now be explained by means of the drawings.

FIG. 1 shows, viewed from the rear, a pin-on clip composed of a printable plate, a support plate and the actual holding clip, FIG. 2 shows a pulled-apart illustration of the pin-on clip according to FIG. 1.

Figure 3:
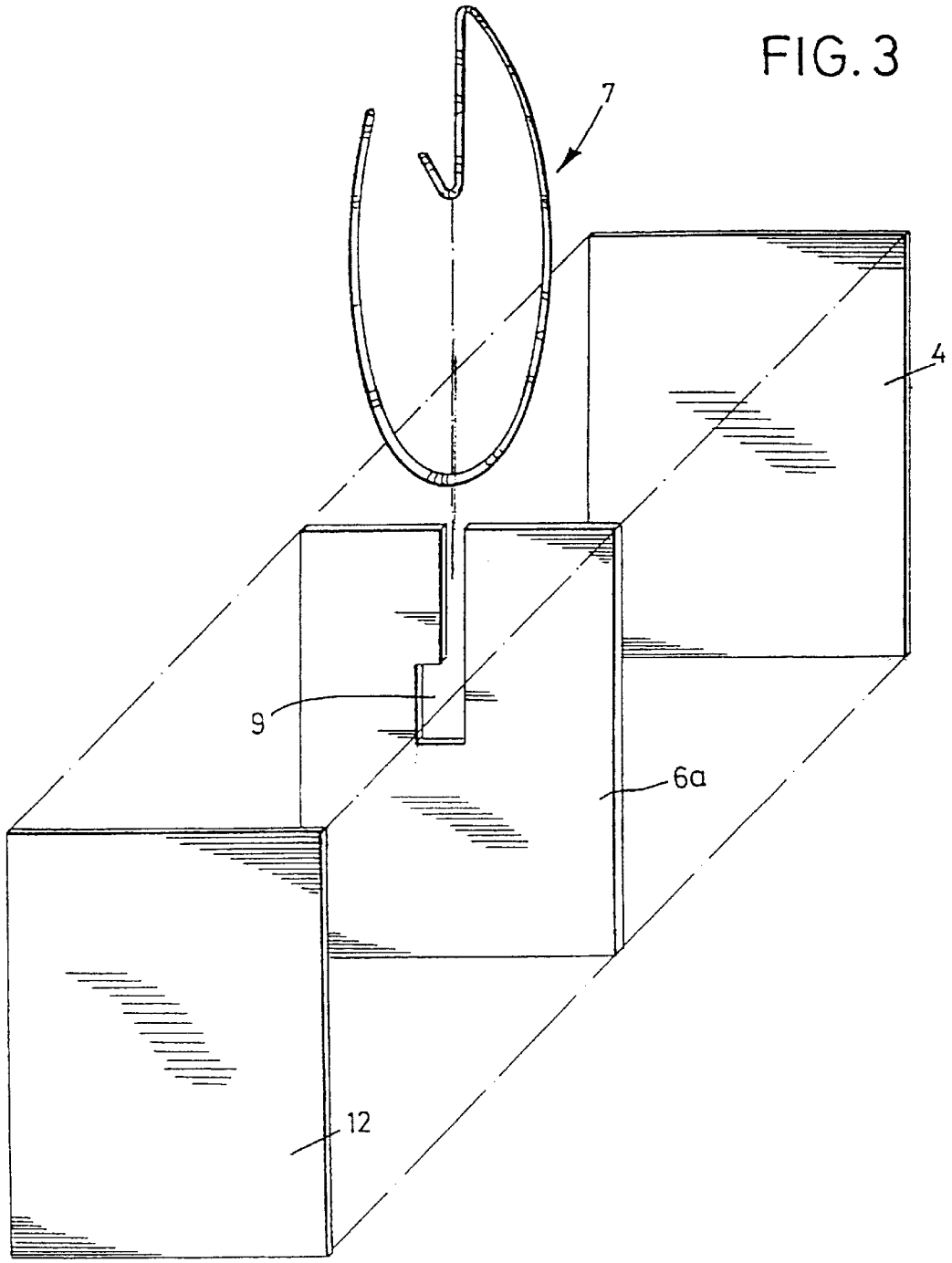
FIG. 3 shows an embodiment of a pin-on clip composed of the different layers.

FIGS. 1 to 3 illustrate a pin-on clip 1 which has a visible side 2 and a reverse side 3, a metallic holding clip 7 being identifiable on the reverse side 3.

The visible side 2 is disposed on a printable plate 4 which may for example comprise a thin layer of paper and is securely located on a support plate 6 via an adhesive layer 5, whereby the support plate 6 may for example be made of cardboard.

In the exemplary embodiment illustrated in FIG. 1, an impressed section or a groove is provided in this support plate 6 directed toward the printable plate 4, creating a receiving orifice 9 in which an anchoring bracket 8 of the holding clip 7 can be inserted. This anchoring bracket 8 has a barb 10 which would be locked in the receiving orifice 9 if the holding clip 7 moved back. At the same time, the formation of the barb 10 on the anchoring bracket 8 creates a tip 14 which makes it easier to insert the anchoring bracket 8 into the receiving orifice 9.

As already stated, fixture of the anchoring bracket 8 can be achieved by a cone profile instead of the barb 10. It is also possible for the anchoring bracket 8 to be designed relatively planar and to be adhered in the receiving orifice 9.

The printable plate 4 is adhered to the support plate 6.

The holding clip 7 protrudes over the lower edge of the pin-on clip 1 and forms a projection 11 which makes it easier to attach the pin-on clip 1.

FIG. 2 shows the individual components of the pin-on clip illustrated in the assembled state in FIG. 1.

FIG. 3 shows a pin-on clip composed of three plates, namely on the one hand the printable plate 4 with the visible side 2, then a relatively thick cardboard plate 6*a* in which the receiving chamber 9 is punched out as a vacant space, the reverse side 3 of the cardboard plate 6*a* being covered by a rear cover plate 12. In this embodiment, the individual plates are also adhered together and then the holding clip 7 is inserted into the receiving orifice 9.

It seems advantageous to make all the components, apart from the actual holding clip 7, from paper or cardboard, though it is, of course, also possible within the scope of this invention to produce individual components from plastic or wood. Textiles can also be used, combinations of these individual materials in particular being conceivable. The printable plate 4 with its visible side 2 makes it possible to employ any printing process, whereby in particular the visible side 2 of the printable plate 4 can also be relief-like in design if the printable plate 4 exhibits a corresponding thickness.

The outer shape of the pin-on clip may be polygonal, circular or exhibit any other shape, whereby this shape can be particularly adapted to the project.

FIGS. 4 to 7 illustrate a pin-on clip 1 which exhibits a visible side 2*a* and a reverse side 3*a,* whereby a metallic holding clip 7*a* is identifiable on the reverse side 3*a*.

The visible side 2*a* is formed by a printable plate 4*a* which can be glued to a support plate 6*b,* the support plate 6*b* being terminated by a reverse cover plate 12*a* on the reverse. The support plate 6*b* comprises microcorrugated cardboard, the longitudinal course of the corrugations extending transverse to the longitudinal extension of a holding clip 7*a,* as clearly shown by FIG. 4. The corrugations of the microcorrugated cardboard are covered by a front cover plate 15 and a rear cover plate 14. The printable plate 4*a* and the cover plate 12*a* are glued to the front and rear cover plates 15 and 14, an adhesive layer 20 being interposed between the printable plate 4*a* and the cover plate 15. The adhesive layer 20 can be formed by an adhesive film effective on both sides and protected by a detachable protective layer. The layer 20 is illustrated with exaggerated thickness in the drawing.

A receiving orifice 9*a* which serves to receive the holding clip 7*a* is provided in the cover plate 12*a,* the rear cover plate 14, the corrugations of the microcorrugated cardboard and the front cover plate 15.

The holding clip 7*a* is e.g. formed by a metal wire which is bent into a loop so as to form two loops 16 and 17 which terminate in hook-like ends 18 and 19 aligned transverse to the longitudinal extension of the loops 16 and 17. These hook-like ends 18 and 19 are passed through the receiving orifices 9*a* and engage with the microcorrugated cardboard in the longitudinal direction of the corrugations, just as is identifiable in FIG. 5 by means of broken lines. This produces a secure fixture of the holding clip 7*a*. As clearly shown by FIG. 6, the loops 16 and 17 are also slightly bent back stepwise from the plane or the support plate 6*b,* thus ensuring that the pin-on clip 1 is easily clipped on.

Figure 6:
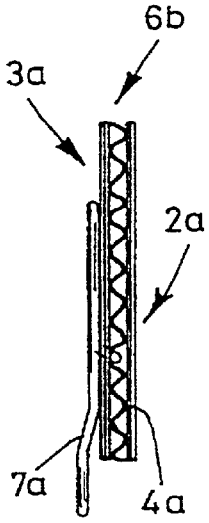
FIG. 6 shows a side view of the arrangement according to FIG. 5.
Figure 7:
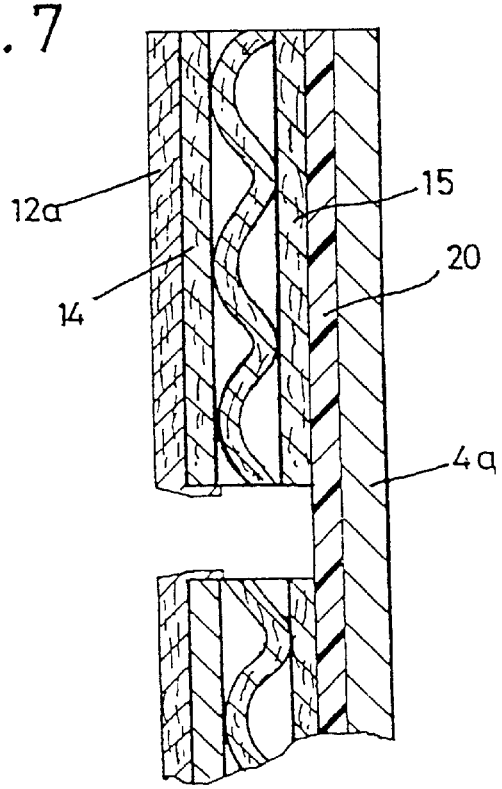
FIG. 7 shows an enlarged sectional illustration.

The so-called support plate 6*b,* which is composed of microcorrugated cardboard in the embodiment according to FIGS. 6 and 7, may also, however, be made of a foam plate, such as foamed polystyrene. The ends 18 and 19 then easily include part of this foam material, thus making it easier to insert the holding clip 7*a*. Instead of the oval hole 9*a* illustrated in FIG. 4, the orifice 9*a* may also comprise, in sure an instance, a simple slot-shaped incision which in any case passes through the cover plate 12*a,* but which can also include part of the foam layer or can even completely pass through the foam layer.

Figure 4:
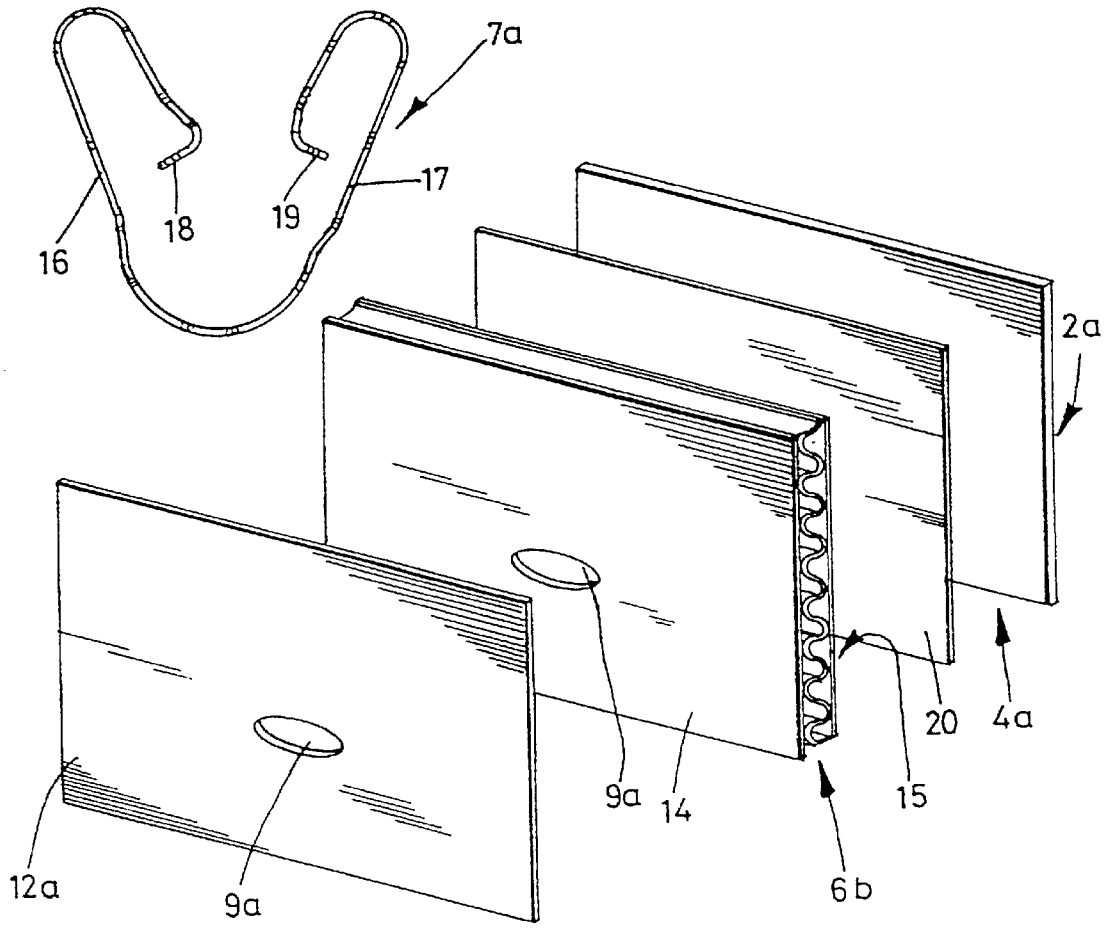
FIG. 4 shows a modified embodiment of the pin-on clip, illustrated in a pulled-apart state, in which microcorrugated cardboard is used.
Figure 5:
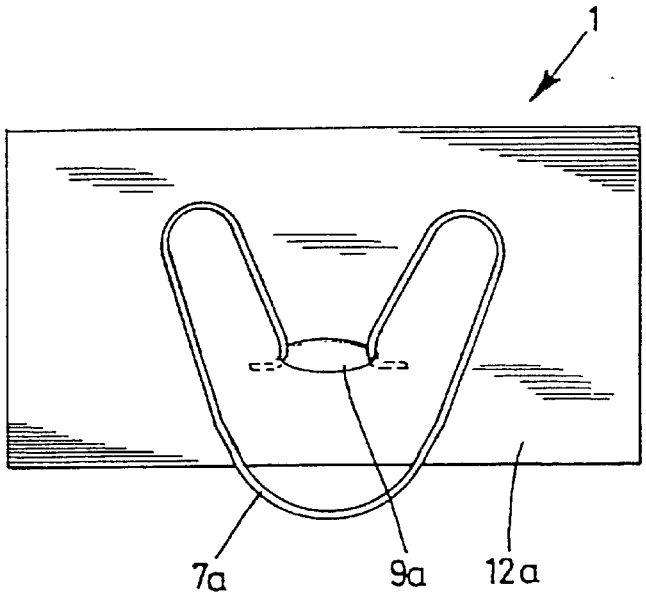
FIG. 5 shows a rear view of a pin-on clip according to FIG. 4.

In this context, attention is again explicitly drawn to the fact that the size ratios used particularly in FIGS. 4 and 7 are depicted in an exaggerated form and were chosen only to illustrate the inventive concept. The size ratios are and can be chosen to be different.

What is claimed is:

1. A pin-on clip comprising a holding clip, a support plate and a front plate, said pin-on clip having a visible side and a rear side opposite to said visible side, wherein said front plate is attached to said support plate and is located on the visible side and has a front surface that can be printed, said holding clip being on the one hand externally located on the reverse side of said pin-on clip and on the other hand being held within said pin-on clip, and said support plate being provided with a receiving orifice and said holding clip having anchoring brackets for securing said holding clip in said receiving orifice, wherein said support plate is made of microcorrugated cardboard and said receiving orifice is accessible from the rear side of said pin-on clip.

2. A pin-on clip according to claim 1, wherein said receiving orifice is punched out of said support plate.

3. A pin-on clip according to claim 1, wherein said receiving orifice is cut into said support plate.

4. A pin-on clip according to claim 1, wherein a rear cover plate is provided on that side of said support plate opposite where said front plate is received.

5. A pin-on clip according to claim 4, wherein said support plate is adhered to said front plate and optionally to said rear cover plate.

6. A pin-on clip according to claim 4, wherein said rear cover plate is made of paper.

7. A pin-on clip according to claim 1, wherein said holding clip comprises two anchoring brackets which when pressed together engage through said receiving orifice and with their hook-like bent ends are fixed in the corrugations of the microcorrugated cardboard or foam layer.

8. A pin-on clip according to claim 7, wherein said holding clip is bent back stepwise from the plane of said support plate.

9. A pin-on clip according to claim 1, wherein said support plate is adhered to said front plate by interposing an adhesive layer.

10. A pin-on clip according to claim 9, wherein said adhesive layer is formed by an adhesive film effective on both sides.

11. A pin-on clip comprising a holding clip, a support plate and a front plate, said pin-on clip having a visible side and a rear side opposite to said visible side, wherein said front plate is attached to said support plate and is located on the visible side and has a front surface that can be printed, said holding clip being on the one hand externally located on the reverse side of said pin-on clip and on the other hand being held within said pin-on clip, and said support plate being provided with a receiving orifice and said holding clip having anchoring brackets for securing said holding clip in said receiving orifice, wherein said support plate is made of a foam plate and said receiving orifice is accessible from the rear side of said pin-on clip.

12. A pin-on clip according to claim 11, wherein said receiving orifice is punched out of said support plate.

13. A pin-on clip according to claim 11, wherein said receiving orifice is cut into said support plate.

14. A pin-on clip according to claim 11, wherein a rear cover plate is provided on that side of said support plate opposite where said front plate is received.

15. A pin-on clip according to claim 14, wherein said support plate is adhered to said front plate and optionally to said rear cover plate.

16. A pin-on clip according to claim 14, wherein said rear cover plate is made of paper.

17. A pin-on clip according to claim 11, wherein said holding clip comprises two anchoring brackets which when pressed together engage though said receiving orifice and with their hook-like bent ends are fixed in the foam layer.

18. A pin-on clip according to claim 17, wherein said holding clip is bent back stepwise from the plane of said support plate.

19. A pin-on clip according to claim 11, wherein said support plate is adhered to said front plate by interposing an adhesive layer.

20. A pin-on clip according to claim 19, wherein said adhesive layer is formed by an adhesive film effective on both sides.

* * * * *